US007487770B2

(12) United States Patent
Johnson et al.

(10) Patent No.: US 7,487,770 B2
(45) Date of Patent: Feb. 10, 2009

(54) ASSIST FOR RAISE LOWER MECHANISM FOR A CONCRETE SAW

(75) Inventors: Adam Johnson, Olathe, KS (US); Douglas Dempsey, Pleasant Hill, MO (US)

(73) Assignee: Husqvarna Professional Outdoor Products Inc., Augusta, GA (US)

( * ) Notice: Subject to any disclaimer, the term of this patent is extended or adjusted under 35 U.S.C. 154(b) by 0 days.

(21) Appl. No.: 11/331,796

(22) Filed: Jan. 14, 2006

(65) Prior Publication Data

US 2007/0164599 A1 Jul. 19, 2007

(51) Int. Cl.
*B28D 1/04* (2006.01)

(52) U.S. Cl. ..... 125/13.03; 299/39.3

(58) Field of Classification Search ..... 299/39.3; 125/13.01, 13.03

See application file for complete search history.

(56) References Cited

U.S. PATENT DOCUMENTS

| | | | | |
|---|---|---|---|---|
| 1,731,872 | A | | 10/1929 | Schons |
| 1,736,538 | A | | 11/1929 | Kurtz |
| 2,673,725 | A | | 3/1954 | Coates |
| 2,736,311 | A | * | 2/1956 | Coates ..... 125/14 |
| 2,882,977 | A | | 4/1959 | Smith |
| 3,357,745 | A | | 12/1967 | Cooper |
| 3,663,060 | A | | 5/1972 | Shatwell |
| 4,310,198 | A | * | 1/1982 | Destree ..... 299/39.3 |
| 4,840,431 | A | | 6/1989 | Jedick |
| 4,921,308 | A | | 5/1990 | Yelton |
| 4,953,523 | A | | 9/1990 | Swan |
| 5,570,677 | A | | 11/1996 | Chiuminatta |
| 5,803,071 | A | | 9/1998 | Chiuminatta |
| 6,019,433 | A | | 2/2000 | Allen |
| 6,484,711 | B2 | | 11/2002 | Acker et al. |
| 6,536,422 | B1 | | 3/2003 | Zuzelo |
| 6,637,423 | B1 | | 10/2003 | Rettenweber et al. |
| 2003/0196650 | A1 | | 10/2003 | Bowman |
| 2004/0159315 | A1 | | 8/2004 | Howard |

* cited by examiner

*Primary Examiner*—Sunil Singh
(74) *Attorney, Agent, or Firm*—Henricks, Slavin & Holmes LLP

(57) ABSTRACT

A pavement treatment apparatus, for example a concrete saw, includes a bias element for biasing one part of the apparatus toward another part of the apparatus. The bias element may be one or more springs extending between an engine platform and a handle assembly.

30 Claims, 6 Drawing Sheets

ASSIST FOR RAISE LOWER MECHANISM FOR A CONCRETE SAW

BACKGROUND

1. Field

These inventions relate to pavement working equipment, including concrete saws.

2. Related Art

Pavement working equipment, for example concrete saws, often include a first structure such as a carriage portion, chassis or frame having wheels or other means for supporting the equipment on the pavement, not only for providing a stable orientation for the equipment relative to the pavement, but also for allowing for easier transport of the equipment before and after use. The working portion of the equipment, for example a saw blade, can be supported on a second structure such as an engine platform that moves up and down relative to the carriage. As the engine platform moves down, the working portion can be brought into contact with the pavement for working the pavement as desired, and as the engine platform moves up, the working portion is removed from the pavement. In many situations, the working portion and the engine driving the working portion are supported on the same structure. Therefore, moving the working portion up and down also means having to raise and lower the engine at the same time, which may take significant effort due to the weight of the engine. While lowering the working portion may take little effort because the engine weight adds to the downward force, raising the working portion takes added effort to overcome the weight of the engine. Therefore, more effort is used to raise the working portion than is used to lower the working portion.

SUMMARY

Pavement treatment devices can be made easier to use by adding a bias or other force component to counteract part or all the force differential experienced between the upward and outward movement of the device. In one example, the effort to move the saw in one direction is made easier than without the bias. In another example, the effort to move the saw in one direction is approximately the same as the effort to move the saw engine in another direction, for example in the opposite direction. In a further example, the weight of the device is balanced by a bias or other force component so that the effort is approximately the same to raise as to lower the device.

In one example of a treatment device, for example a concrete saw, the device includes a frame and a handle component supported by the frame. A support is movable relative to the frame, for example through a pivoting movement about a pivot axis, so that the support and the frame are relatively movable. A bias element extends between the relatively movable parts, in one example between the handle component and the movable support. In one configuration, the support is an engine platform and the bias element extends between the handle component and the engine platform. In another configuration, the bias element extends at a substantial angle, for example at a substantial angle to the handle component or at a substantial angle to the support such as the engine platform, or both, in other words at a substantial angle to both of the relatively movable parts. In another configuration, the bias element extends at an angle greater than 10 degrees, for example greater than 10 degrees from the handle element and greater than 10 degrees from the engine platform. In a further configuration, the device includes a raise lower mechanism and the handle component includes a handle support extending between the handle component and the frame and where the raise lower mechanism is substantially parallel to the handle support. In another configuration having a raise lower mechanism, the bias element may cross over the raise lower mechanism.

In another example of a treatment device, the device includes a support and a handle assembly extending in a direction upward and away from the support, wherein the support and the handle assembly are relatively movable relative to each other. The device further includes a space adjustment mechanism for adjusting a spacing between the support and the handle assembly. In one configuration, the support is an engine platform and the space adjustment mechanism is a raise lower mechanism for raising and lowering the engine platform relative to the handle assembly. In this example, a bias element extends between the handle assembly and the support wherein the bias element and the space adjustment mechanism are non-parallel with respect to each other. In one configuration, the bias element and the space adjustment mechanism cross each other. In another configuration, the handle assembly includes a post extending upward and away from a frame to a handle, and the bias element is supported on the post approximately midway between the frame and handle. In a further configuration, the space adjustment mechanism is a screw feed mechanism, and the bias element and the screw feed mechanism cross each other.

In a further example of a treatment device, a frame supports a handle element and a bias element extends from a portion of the handle element to a portion of a motor support. The frame and the motor support pivot relative to each other about a pivot axis. The bias element extends along a line where the closest distance from the pivot axis to the line is at least about an inch. In one configuration, the closest distance is greater than an inch, and may be greater than two inches. In one configuration, the handle element is supported on the frame by a post and the bias element is supported on the post about halfway along the length of the post. In another configuration, the device includes a height adjustment mechanism for moving the frame relative to the motor support about the pivot axis. The height adjustment mechanism can be non-parallel to the bias element. In one configuration, the height adjustment mechanism crosses the bias element.

These and other examples are set forth more fully below in conjunction with drawings, a brief description of which follows.

DETAILED DESCRIPTION

Figure 1:
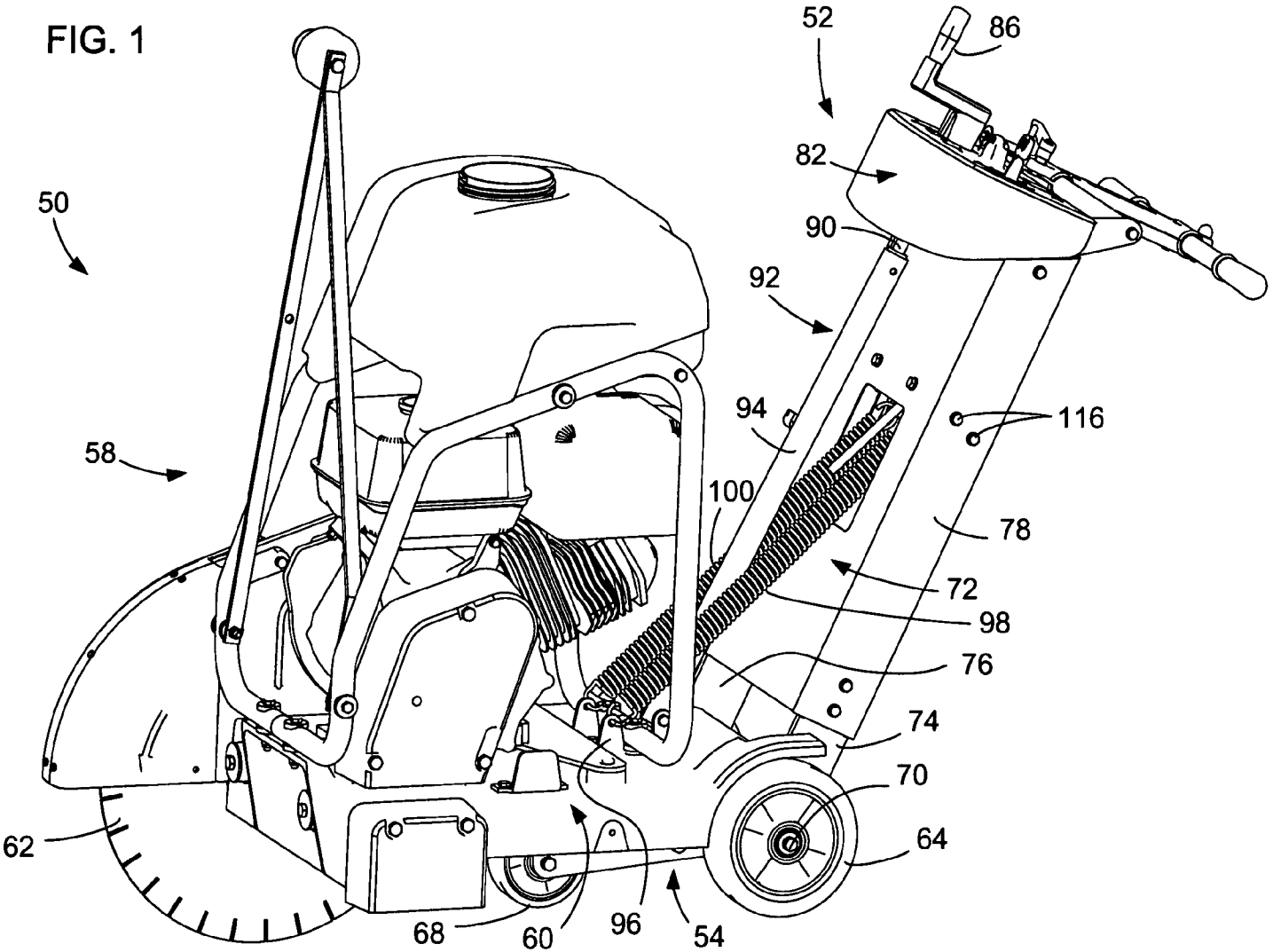
FIG. 1 is a front left isometric view of a pavement treatment device in the form of a concrete saw in accordance with one example of the present inventions.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of pavement treatment devices are described. A concrete saw is used as the example of a pavement treatment device, and a number of concrete saw configurations are particularly suited for the present inventions. In the concrete saw described herein, one or more bias elements can be used to allow an operator to more easily raise and/or lower the saw blade (or other portion of the saw) from one position to another. In one example, bias elements may be used to make it easier to more easily a raise and/or lower the saw blade compared to the effort used without bias elements. In another example, bias elements may be used to make it just as easy to raise the saw blade as it is to lower the saw blade. In a further example, bias elements may be used to make raising the saw blade easier than lowering the saw blade.

These and other benefits will become more apparent with consideration of the description of the examples herein. However it should be understood that not all of the benefits or features discussed with respect to a particular example must be incorporated into a treatment device in order to achieve one or more benefits contemplated by these examples. Additionally, it should be understood that features of the examples can be incorporated into a device to achieve some measure of a given benefit even though the benefit may not be optimal compared to other possible configurations. For example, one or more benefits may not be optimized for a given configuration in order to achieve cost reductions, efficiencies or other reasons known to the person settling on a particular product configuration or method.

Examples of a number of device configurations and of methods of using the devices are described herein, and some have particular benefits in being used together. However, even though these apparatus and methods are considered together at this point, there is no requirement that all of them be combined, used together, or that one component or method be used with any other component or method, or combination. Additionally, it will be understood that a given component or method could be combined with other structures or methods not expressly discussed herein while still achieving desirable results.

Concrete saws are used as examples of pavement treatment devices that can incorporate one or more of the features and derive some of the benefits described herein. Concrete saws often have frames or chassis and engine platforms that move relative to each other, allowing the saw blade to be brought into contact or removed from the concrete without moving the frame or chassis. However, machines other than concrete saws can benefit from one or more of the present inventions.

In one example of a pavement treatment apparatus in the form of a concrete saw (FIGS. 1-5), a portable saw 50 includes a frame assembly having relatively movable parts, for example a first frame element and a second frame element. In the present example, a handle assembly 52 is supported on a first frame element in the form of a carriage 54 (FIG. 3), which may also be a chassis or other structure for supporting the saw on a surface, such as the concrete surface 56. An engine 58 is supported on a second frame element in the form of an engine platform 60 for driving a saw blade 62 mounted on and supported by a drive shaft (not shown). In the present examples, the saw blade is mounted at a right front portion of the saw, but the blade can also be mounted at the left front of the saw, or at other locations on the saw.

The carriage 54 is supported on the concrete surface 56 by left and right rear wheels 64 and 66 (FIGS. 1-4), respectively. The terms "left" and "right" are used herein to designate an orientation of the saw relative to an operator standing behind the saw handle assembly 52 (to the right of the saw as shown in FIG. 1). The terms are used to assist in presenting a description of the saw, and are not intended to limit or restrict application of the inventions to any particular structure or orientation. The carriage is also supported by front wheels 68, only the left one of which is shown in the drawings. In this example, the rear wheels are supported on an axle extending substantially the width of the saw, the ends of which are represented at 70 by fastener heads, bolts or other terminations for the axle. The axle is preferably a straight rod extending substantially from the left wheel 64 to the right wheel 66, through suitable openings through a rear portion of the carriage.

In the example shown in the drawings, the axle also extends through openings in the engine platform 60. The engine platform 60 pivots relative to the carriage 54. In the example of the saw shown in the drawings, the carriage 54 rolls along the concrete surface, and the carriage remains relatively level. As the engine platform pivots about the axle 70, the engine platform extends at a smaller or larger angle relative to the concrete surface 56. By having the engine platform 60 pivot relative to the carriage 54, and therefore pivot relative to the concrete surface 56, the saw blade 62 can be lowered toward or raised away from the concrete surface.

A bias element 72 extends between the two relatively movable parts, in the present example between the handle assembly 52 and the engine platform 60. The bias element 72 biases the engine platform toward the handle assembly. In the example shown in FIG. 3, the bias element extends at a substantial angle to the handle assembly and also at a substantial angle to the engine platform. A more than insubstantial angle increases the bias experienced by the engine platform, for example to the extent of the distances along the relatively moving parts that the respective ends of the bias element 72 are positioned away from the axle 70. To the extent that the respective distances combined with the bias element form the three sides of a triangle, and the triangle is an isosceles triangle, the effect of the bias element is enhanced. Conversely, where the ratio of the two distances are significantly different, the effect of the bias element on the engine platform is reduced. For example, if the ratio of the two distances is less than 0.1 (where the shorter of the two distances is in the numerator, and the longer of the two distances is in the denominator), the benefit provided by the bias element is significantly reduced, and may not be even noticeable.

In another aspect of the bias element 72, the two distances (that the respective ends of the bias element 72 are positioned away from the axle 70) are preferably large enough so that the bias provided by the bias element 72 is noticeable, compared to a saw configuration where the bias element is not present. For example, consider a line that extends through the axle 70 and is perpendicular to the bias element 72 (a line normal to the bias element). Where the normal line has a length between the center of the axle and the center of the bias element 72 greater than about one inch, the bias provided by the bias element 72 is noticeable compared to a saw configuration without a bias element. The length of the normal line is greater than about 1 inch when the bias element 72 is sized and configured in such away as to be capable of being mounted on the saw. Conversely, where the bias element 72 is a spring with a very large spring constant, the effect of the spring could be noticeable where the perpendicular length is less than about an inch. However, the spring would be so large that only a small portion of the spring cross-section would be within one inch of the axle 70.

Considering the saw structure in more detail, the frame assembly can take a number of configurations, and those skilled in the art will appreciate that movable machines with which various parts of the present examples can be used are also numerous. In the example of the pavement treatment device shown in FIGS. 1-5, the engine platform supports the motor 58, the blade 62 and a drive assembly for driving the blade from the motor. The drive assembly may include a blade drive shaft to which the saw blade is mounted, a drive belt and pulleys, and the like. The engine platform 60 can have a number of shapes and sizes, and the configuration of the engine platform is preferably such as to reliably support the motor 58, the drive assembly and the blade 62 during normal operation over the lifetime of the saw. The engine platform shown in FIGS. 1-5 is a cast part, and includes structures for strength, mounting structures for various components, some of which are described herein, as well as structures for receiving an axle assembly including the axle 70 for the rear wheels of the saw, 64 and 66.

The frame assembly also includes the carriage assembly 54, which has left and right posts 74 and 76, respectively, extending upwardly and rearwardly from the carriage assembly 54. The posts 74 and 76 are fixed relative to and may be integral with the carriage assembly 54. The posts 74 and 76 receive and support the handle assembly 52 extending rearwardly and/or upwardly from the carriage assembly. In the present example, a left beam 78 and a right beam 80 are fastened to and supported by respective ones of the left and right posts 74 and 76, so that the posts are preferably fixed relative to the carriage assembly. As the posts are moved, such as through the handle assembly 52, the carriage assembly is also moved. Additionally, the engine platform 60 is pivotally mounted about the rear axle, and the engine platform 60 and the parts supported by it can be moved through movement of the handle assembly relative to the ground 56.

The posts and the carriage assembly are relatively rigid structures with respect to each other so that the carriage assembly can reliably support the engine platform and any motor, drive and blade combination and so that the handle assembly can be used conveniently to move the saw during use, for storage or for transporting to or from a job site. While the frame assembly can take a number of configurations, the present examples have the engine platform 60 pivoting around the axis coaxial with the axle for the rear wheels 64 and 66 relative to the carriage assembly 54 and the posts 74 and 76. The carriage assembly and the handle assembly are preferably fixed relative to each other so the raising and lowering of the saw blade by raising and lowering the engine platform keeps the handle assembly at a relatively constant position for the operator. Other configurations can have the frame portion supporting the handle assembly mounted to the engine platform instead of the carriage assembly, or one or more of the wheels supported independently on the engine platform, thereby changing the configuration for or eliminating the carriage assembly. Other configurations are possible as well. Other configurations may use skids instead of wheels to support a saw on the concrete, and other configurations of a saw can use other mechanisms to raise and lower the blade for cutting. Additionally, the handle assembly can be coupled to the carriage assembly through one structure such as a single post or from more than two posts, rather than two posts as shown in the drawings. A single post configuration is shown in the U.S. Pat. No. 5,381,780, incorporated herein by reference, in which a handle assembly is generally indicated by reference 56. However, for purposes of the present description, the handle support 58 and handle extension 60 in that patent will be considered part of the handle assembly supporting the cross bar 62 of the handle.

Figure 2:
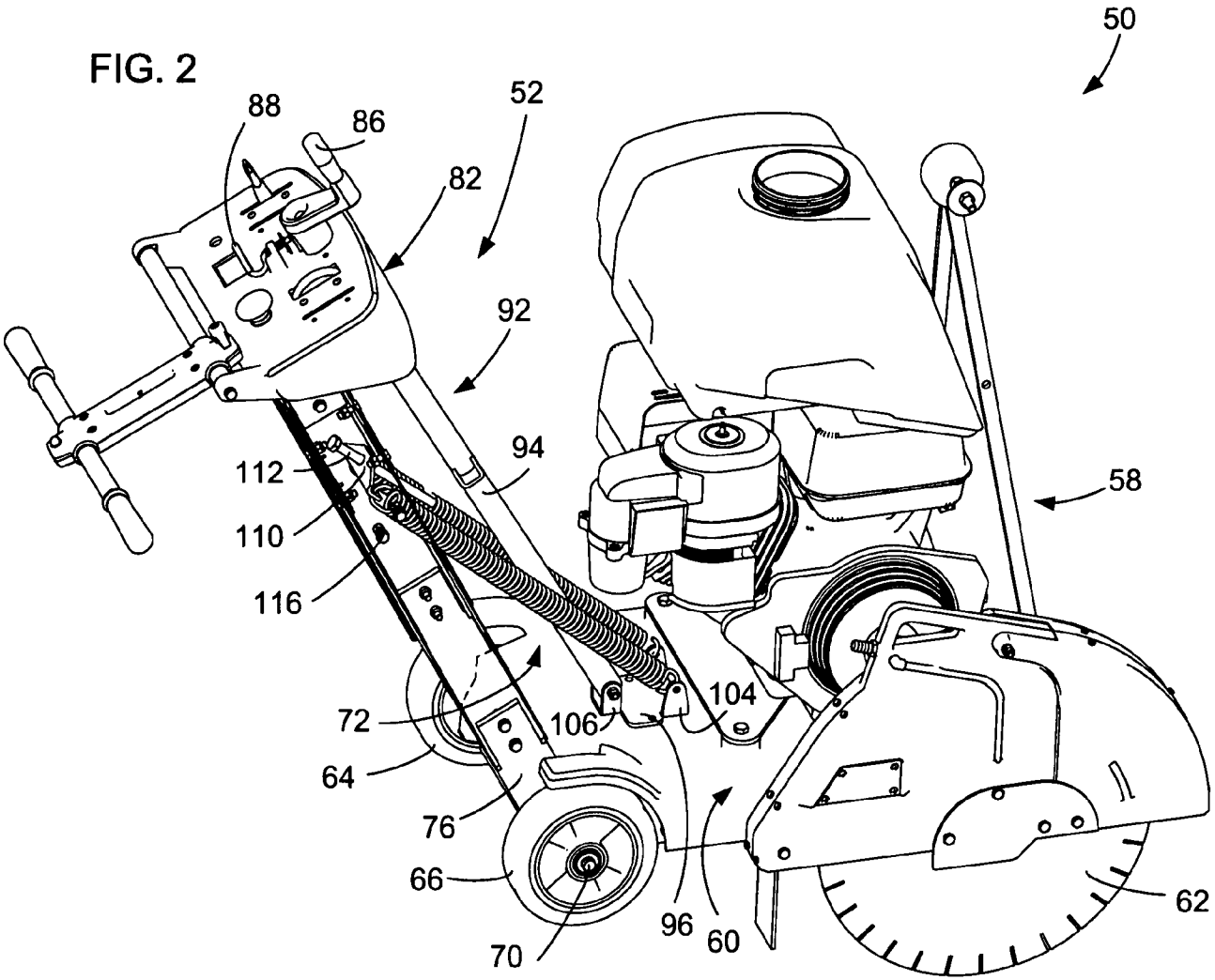
FIG. 2 is a right rear isometric and partial cutaway view of the saw of FIG. 1.

In the present example, the left and right beams 78 and 80 support a control console 82 accessible to an operator for controlling various functions of the saw. The console may include an engine control 84, for example for turning off the engine, and a blade height control handle 86 (FIG. 2). The blade height control handle 86 can be locked in position using a biased handle locking pin 88 (FIGS. 1-5). The control console or other locations around the posts can also include other components such as a water supply valve, and other elements useful for operating the saw.

The blade height control handle 86 is fixed to an upper rotating portion 90 (FIGS. 1 and 4) of a screw adjustment assembly 92. The screw adjustment assembly 92 adjusts the height of the blade through turning of the blade height adjustment handle 86. The upper rotating portion 90 includes a threaded portion engaging a complementary threaded portion on the inside of the stationary tube 94, so that threading the upper rotating portion 90 into or out of the stationary portion 94 changes the length of the screw adjustment assembly. The end of the stationary tube 94 opposite the upper rotating portion 90 is fixed to and supported by a mounting bracket 96, which in turn is mounted to and supported by the engine platform 60. Changing the length of the screw adjustment assembly raises or lowers the saw blade relative to the ground 56 by pivoting the engine platform 60 about the rear axle 70 relative to the carriage 54. As can be seen most easily in FIGS. 3 and 4, the screw adjustment assembly 92 extends approximately or even substantially parallel to the posts 78 and 80 over a wide range of motion of the engine platform 60. While the upper portion and/or the lower portion of the screw adjustment assembly 92 can each be positioned closer or farther away from the posts 78 and 80, having the screw adjustment assembly 92 approximately parallel to the posts 78 and 80 is acceptable for operating purposes and for ease of assembly and maintenance.

The bias assembly 72 can take a number of configurations. In the present examples, the bias assembly 72 urges the engine platform 60 away from the carriage 54. This bias acts against the weight of the motor 58 and its downward force, which downward force tends to push the engine platform 60 toward the carriage 54. In the present examples, the bias tends to pull the engine platform upward toward the handle assembly, though it should be understood that the bias can be oriented in other directions.

In the example shown in the drawings, the bias assembly 72 includes left and right springs 98 and 100, respectively, each of which are mounted at their lower portions to respective tabs 102 and 104 on the mounting bracket 96. Each of the springs includes respective hook portions or other mounting configurations for engaging their respective tabs on the mounting bracket 96. The tabs extend upwardly from the engine platform 60, to give spacing for installing and removing the springs from the mounting bracket 96.

As can be seen for example in FIG. 2, the tabs 102 and 104 are positioned on the mounting bracket 96 forward of the screw adjustment assembly 92. The stationary tube 94 of the screw adjustment assembly is bolted to upwardly extending tabs 106 on the mounting bracket 96. The screw adjustment assembly is preferably linear between the handle assembly and the tabs 106. The tabs 106 are positioned on the mounting bracket 96 behind the tabs 102 and 104 for the springs. The bolt allows the screw adjustment assembly to pivot as the engine platform is raised and lowered. The mounting bracket 96 is fixed to the engine platform, such as through bolts, welding or otherwise. It should be noted that the springs and the screw adjustment assembly can be mounted to the engine platform 60 the same distance from the posts 74 and 76, or the screw adjustment assembly can be mounted to the engine platform forward of the springs. However, mounting the screw adjustment closer to the axis 70 permits faster raising and lower of the engine platform for a given turn of the handle 86. Mounting of the springs on the engine platform forward of the screw adjustment assembly gives sufficient room on the engine platform to mount the springs at a position significantly forward of the axle 70, about which the engine platform pivots. Additionally, mounting of the springs on the engine platform significantly forward of the axle 70 improves the effect of the springs to bias the engine platform in the direction of the springs.

Figure 5:
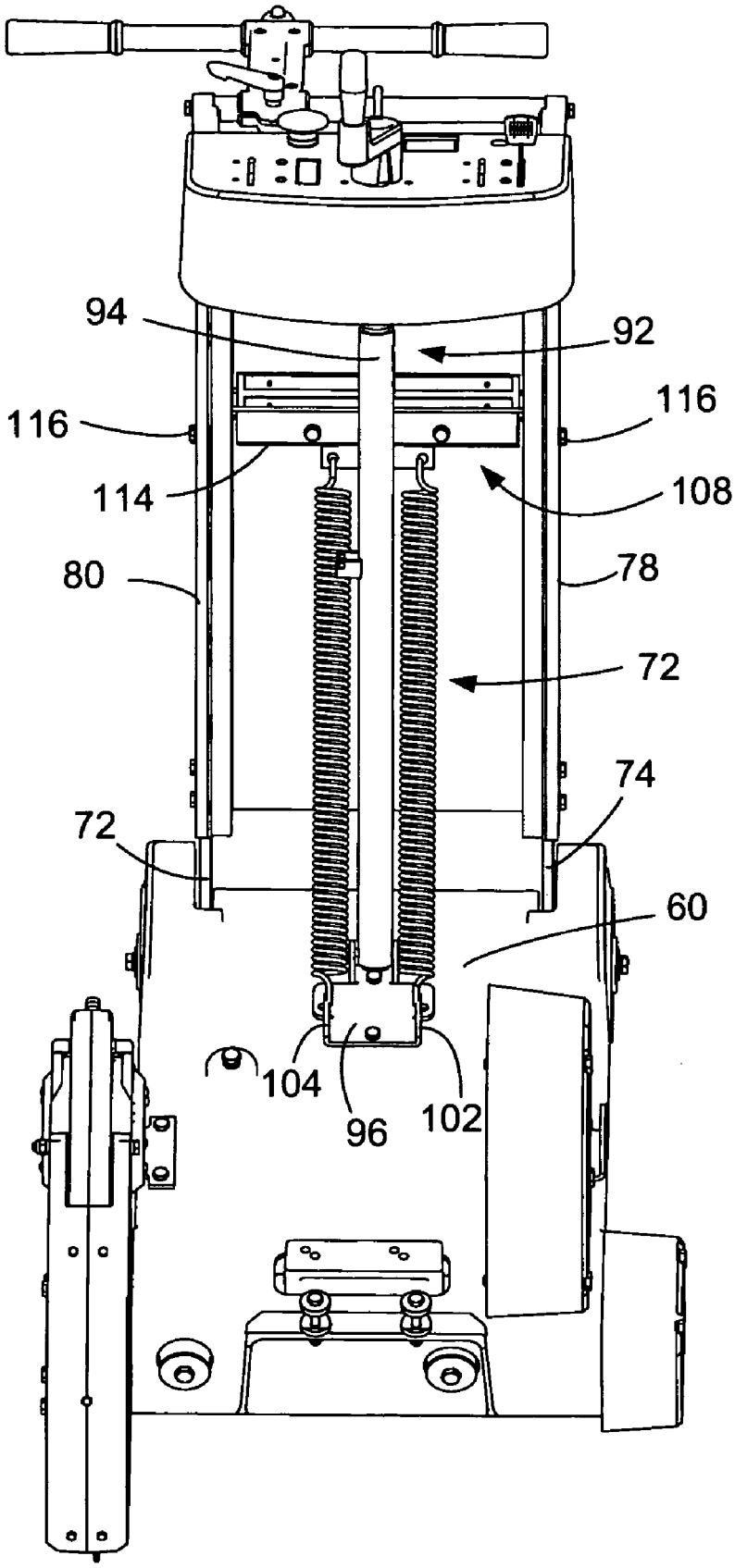
FIG. 5 is an upper front view of a portion of the saw of FIG. 1 showing bias element in the form of springs extending between a handle assembly and an engine platform.
Figure 6:
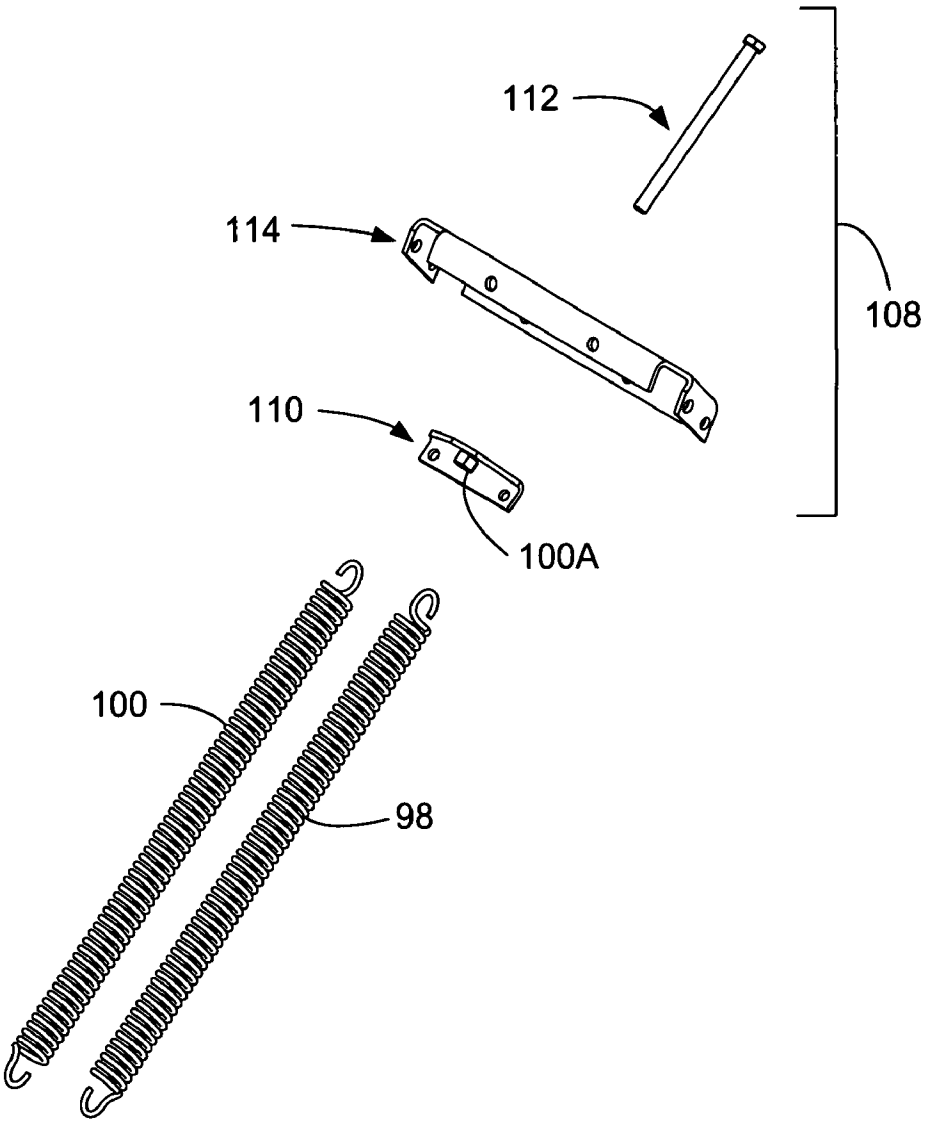
FIG. 6 is an exploded view of an adjustable bias assembly for use in the saw of FIG. 1.

At their upper ends, the springs 98 and 100 are supported by an adjustable mounting bracket 108 removably fixed to the handle assembly 52 (FIGS. 2 and 5). In the example shown in the drawings, the mounting bracket 108 is adjustable to allow changing the overall length of the springs, thereby adjusting the upward bias applied through the springs to the engine platform 60. As the springs are extended, the bias experienced by the engine platform increases, and as the springs are relaxed the bias decreases. The mounting bracket 108 preferably adjusts both springs at the same time.

In the present example, the upper ends of the springs 98 and 100 are hooked through respective holes in an angle plate 110. The holes are in a portion of the angle plate that extends parallel to the direction of the springs. The transverse portion of the angle plate includes an opening through which an adjustment bolt 112 extends. The bolt is fully threaded, and the bolt and a portion 110A of the opening in the adjustment plate are in threaded engagement so that turning the bolt moves the plate along the shaft of the bolt. By turning the bolt, the springs can be extended or relaxed as desired. The range of movement of the springs can be determined by the length of the bolt 112. The bolt also extends through an un-threaded opening in a cross piece 114 (FIG. 5), and the head of the bolt is supported by and rests on a surface of the cross piece 114. The cross piece 114 is supported through respective fasteners 116 passing through the sides of the posts 78 and 80. The cross piece 114 is fixed relative to the handle assembly, while the bolt 112 can rotate and the angle bracket 110 can travel up and down the length of the bolt. The angle bracket 110 and the bolt 112 are means for adjusting the bias element 72. Other means also may be used for adjusting the bias element.

Figures 3, 3A:
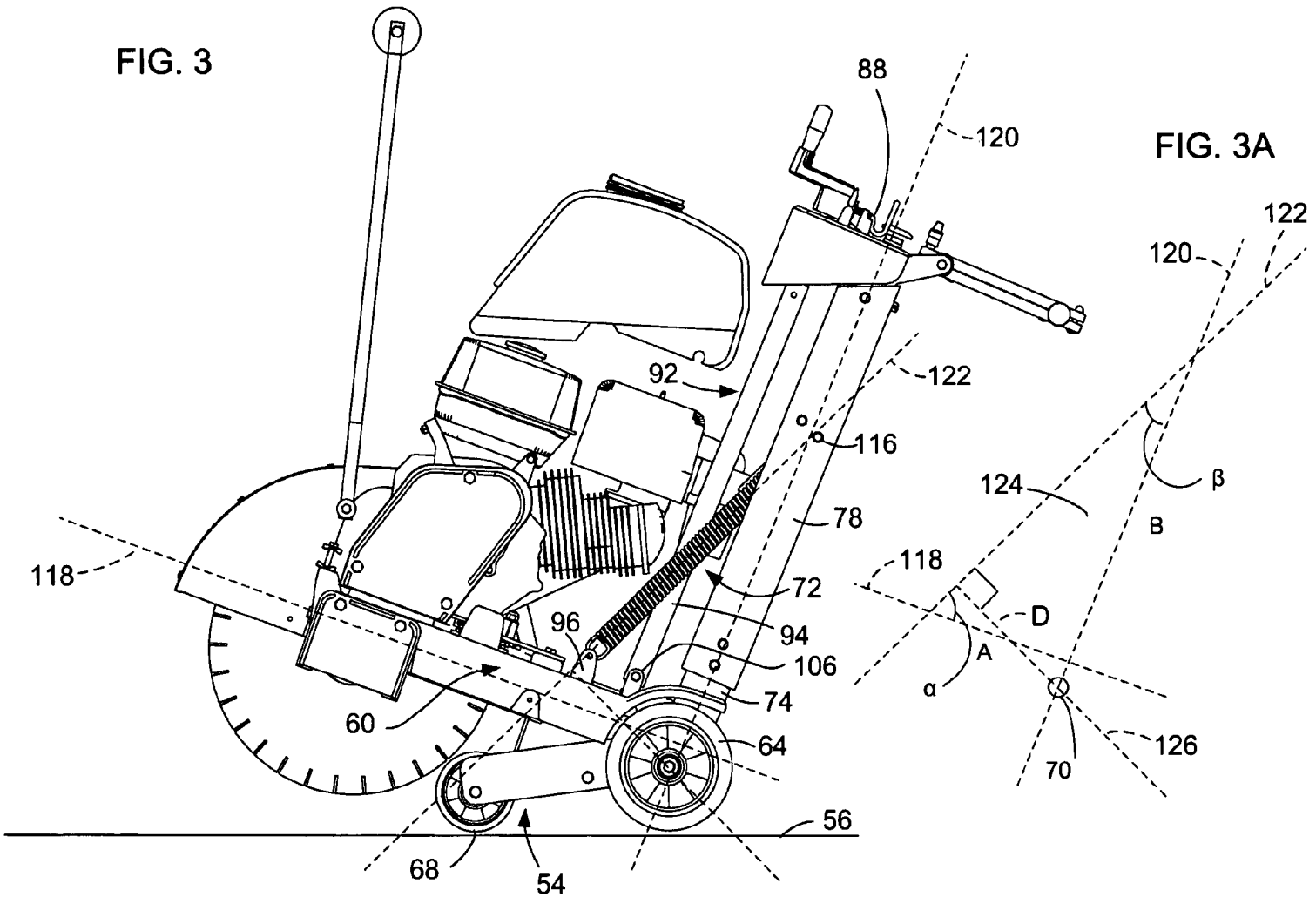
FIG. 3 is a left side view of the saw of FIG. 1 in a raised position.
FIG. 3A is a schematic representation of the angular positions of portions of the saw relative to each other.
Figure 4:
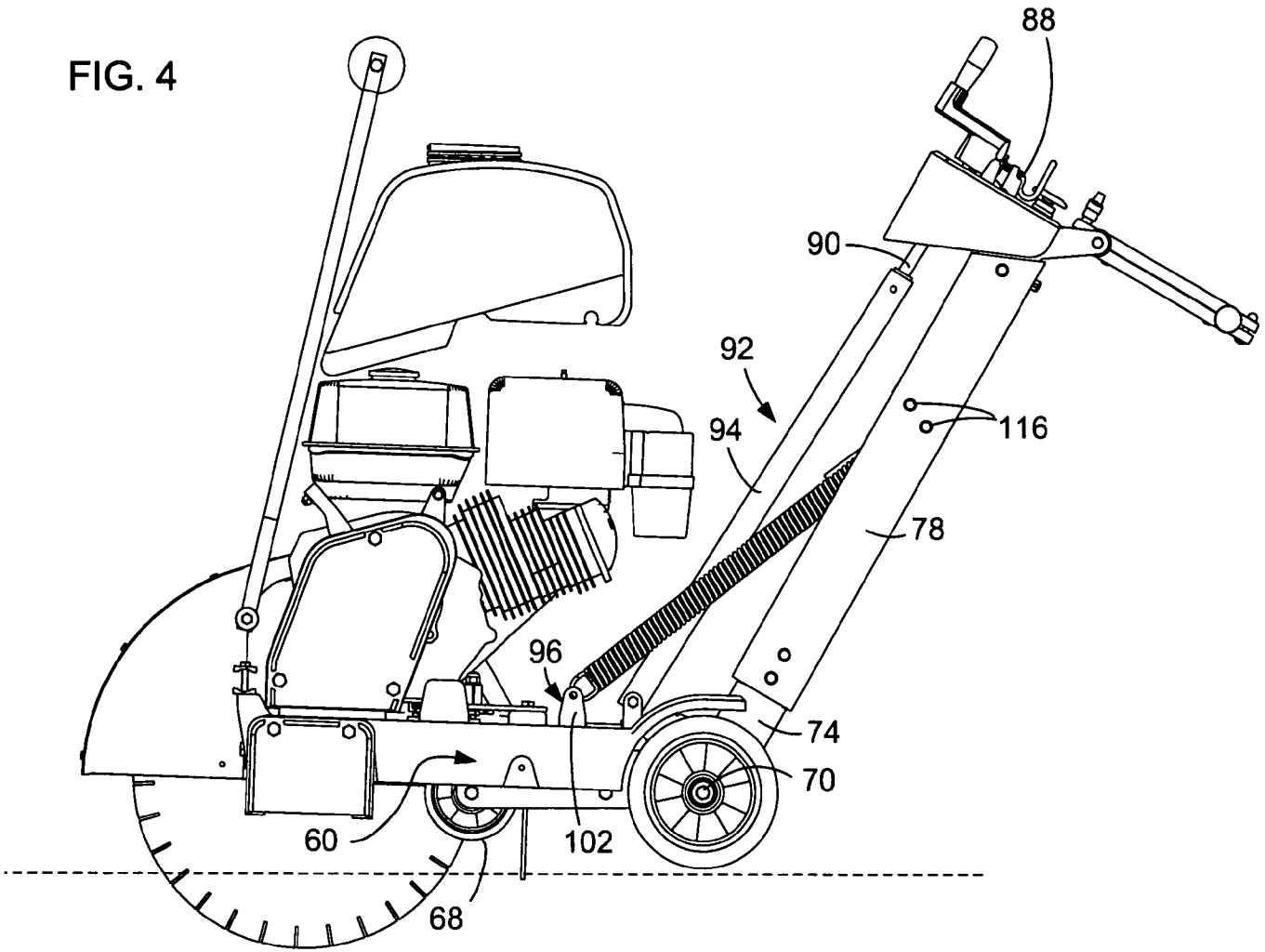
FIG. 4 is a left side view of the saw of FIG. 1 in a lowered position.

In one example of the saw, such as the example shown in the drawings, the adjustable bias elements 72 extend at a substantial angle both to the handle assembly and to the engine platform. For example, as shown in FIGS. 3 and 3A, the dashed line 118 represents a line containing the engine platform extending in a direction in which the engine platform extends. The handle assembly includes the dashed line 120 extending in the same direction that the posts of the handle assembly extend. The lines 118 and 120 intersect, and the angle between them varies according to the extent that the engine platform is raised and lowered. The line 122 extends in the same direction as the springs 98 and 100, and intersects the line 118 of the engine platform, and intersects the line 120 of the post of the handle assembly. The angle Alpha between the springs line 122 and the engine platform line 118 is a substantial angle. In the example shown in the drawings where the engine platform is raised, the angle Alpha is greater than 50 degrees, and approximately 60 degrees, and preferably between approximately 25-65 degrees. The angle Beta between the springs line 122 and the handle post line 120 is also a substantial angle. In the example shown in the drawings where the engine platform is raised, the angle Beta is greater than 15 degrees, approximately 25 degrees in the example, and between approximately 20-60 degrees. While it is not necessary that both angles be substantial, having both angles Alpha and Beta greater than an insubstantial angle provides a more significant bias for a given spring constant. Where the bias element is other than one or more springs, having both angles Alpha and Beta greater than an insubstantial angle provides a more significant application of a given bias force. Generally, it is believed that an insubstantial angle is one that is less than approximately 10 degrees, and in the present examples at least one and often both angles are greater than approximately 15 degrees.

As can be seen schematically in FIG. 3A, the engine platform 60 as represented by the engine platform line 118, the handle posts 78 and 80 as represented by the handle post line 120 and the springs 98 and 100 as represented by the springs line 122 intersect to form a triangle 124. It is desirable for improved application of the bias or other force from the springs (or other bias element) for the two adjacent sides A and B to form approximately an isosceles triangle. In other words, it is desirable to have the two adjacent sides A and B of approximately equal lengths. Additionally, it is desirable to have the lengths of the sides longer than shorter for a given bias element. For example, for a given spring constant and length, longer adjacent sides A and B provide an improved bias relative to shorter sides. However, a number of circumstances, such as compact equipment design, may not give much flexibility in where the bias elements are mounted. For example in the configuration shown in FIG. 3, the engine location and orientation is such that the length of the side A is less than the length of the side B so that the springs can still be mounted directly to the engine platform through the bracket 96. Therefore, while one example has the springs oriented and mounted in such away as to form an isosceles triangle, where the ratio of the length of the side A to the length of the side B is "1", the ratio of the sides represented in FIG. 3A is less than "1", where the shorter side is in the numerator. While a desirable ratio approaches "1", ratios less than "1" may also be suitable, but one design goal may be to have the ratio greater than approximately 0.10 and preferably greater than 0.20.

In the example shown in the drawings, the length B corresponds to the approximate point above the engine platform at which the bias element is attached. The length B is approximately halfway between the engine platform and the top of the handle assembly. Supporting the bias element at an approximate halfway point between the bottom and top of the handle assembly may provide a measure of balance or improved stability for application of a bias or other force between the handle assembly and the engine platform.

In the representation of the springs orientation shown in FIG. 3A, the springs extend along the line 122. The springs can be considered to extend in a direction represented by the line 122, and the line can extend in both directions beyond the ends of the springs. The line 122 extends past the pivot point represented by the axle 70 between the carriage assembly/handle assembly and the engine platform 60. The point of closest approach of the line 122 to the pivot point has a distance represented by "D", and it is well understood that the point of closest approach is on a line 126 through the pivot point 70 and perpendicular to the springs line 122. For a given bias element, the effect of the bias or other force on the engine platform is improved where the distance D is greater, compared to the situation where the distance "D" is shorter. Therefore, another design consideration may be to optimize the length "D". In one example, the length "D" is greater than one inch, and improved results may be achieved as the length "D" increases.

In the example shown in the drawings, the bias element is a pair of substantially identical springs. In other examples, the bias element may be a gas element such as a gas piston or other gas cylinder, surgical tubing or other similar resilient element, jack structure, or the like. The bias element may also be combinations of individual bias elements. Additionally, a combination of more than one individual structure forming a bias element can have the structures identical or different. In the example of more than one spring, the springs can have different spring constants, different lengths, different diameters, different orientations or attachment points or other different configurations with respect to each other. Additionally, the bias element can be configured to apply the bias at a number of locations on the engine platform or other application point for the bias. For example, the mounting bracket 96 can have tabs extending higher off the engine platform than is desired for easy attachment of the springs, for example several inches or more above the platform. In another example, the springs can be attached to the engine platform through a frame, lifting cage or other structure extending above the engine platform. Additionally, the springs can also be attached to other structures which are in turn supported by the respective relatively moving parts (thereby making the other structures themselves relatively moving parts). The other structure may be attached directly to the engine platform or to the handle assembly. With an appropriate combination of bias element and attachment configuration for the bias element, the engine platform and therefore the saw blade in the present example can be raised with a handle 86 just as easy as it can be lowered. Additionally, the combination can be selected so that it is easier to raise the blade than it is to lower it or it can be selected so that it is easier to lower the blade than to raise it.

The height adjustment mechanism 92 can also take a number of configurations. The mechanism 92 can be a rod or other linkage to a height adjustment handle. The mechanism can also be an air or other fluid cylinder, as well as other structures.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A concrete treatment device comprising:

a handle assembly;

an engine platform supporting an engine for driving a concrete treatment tool;

a frame portion pivotally engaging the engine platform such that the engine platform and the frame portion are relatively pivoting parts and can pivot toward and away from each other;

a bias element extending between the handle assembly and the engine platform configured to bias the engine platform toward the handle assembly when the engine platform and the frame portion pivot toward each other and when the engine platform and the frame portion pivot away from each other and wherein the bias element extends at a substantial angle to at least one of the relatively pivoting parts.

2. The device of claim 1 wherein the handle assembly includes a relatively straight post extending upward and away from the frame portion and wherein the bias element extends at an angle to the post between about 20-60 degrees.

3. A concrete treatment device comprising:

a handle assembly;

an engine platform supporting an engine for driving a concrete treatment tool;

a frame portion pivotally engaging the engine platform such that the engine platform and the frame portion are relatively pivoting parts;

a bias element extending between the handle assembly and the engine platform configured to bias the engine platform toward the handle assembly wherein the bias element extends at a substantial angle to at least one of the relatively pivoting parts; and a raise lower mechanism extending between a portion of the handle assembly and the engine platform, wherein the handle assembly includes a support extending upward from the frame portion and wherein the raise lower mechanism extends substantially parallel to the support.

4. A concrete treatment device comprising:

an engine support;

a handle assembly extending in a direction upward and away from the engine support wherein the engine support and the handle assembly are relatively moveable with respect to each other;

a space adjustment mechanism for adjusting a spacing between the engine support and the handle assembly, wherein the space adjustment mechanism extends from the handle assembly at an assembly support point to the engine support at an engine support point wherein the assembly support point and engine support point define a first line; and a bias element extending between the handle assembly at a first bias element support point and the engine support at a second bias element support point wherein the first and second support points define a second line and wherein the first and second lines cross.

5. The device of claim 4 wherein the handle assembly includes a post having an approximate midway point and wherein the first bias element support point is approximately at the midway point.

6. The device of claim 4 wherein the engine support is an engine platform and wherein the space adjustment mechanism is a screw feed having first and second end portions, and wherein the second end portion of the screw feed is fixed to the engine platform so as to substantially prevent rotation of the second end portion relative to the engine platform.

7. The device of claim 6 wherein the screw feed includes an internally threaded portion adjacent the second end portion and an externally threaded portion engaging the internally threaded portion and having an end portion supported by the handle assembly.

8. The device of claim 7 wherein the bias element extends from one side of the screw feed to another side of the screw feed.

9. The device of claim 4 wherein the space adjustment mechanism includes a screw feed assembly and wherein the bias element includes a spring.

10. The device of claim 9 wherein the screw feed assembly extends from a top portion of the handle assembly to the engine support, and wherein the spring extends from a portion of the handle assembly between the top portion of the handle assembly and the engine support to an attachment location on the engine support.

11. The device of claim 10 wherein the handle assembly includes a post and wherein the spring extends from an approximate mid portion of the post.

12. The device of claim 11 wherein the screw feed is attached to the engine support at a first location rearward of the attachment location for the spring.

13. The device of claim 4 wherein the handle assembly extends at a first angle from the engine support and wherein the space adjustment mechanism extends at an angle from the engine support no different from the first angle than approximately 15 degrees, and wherein the bias element extends from the engine support at a second angle that is different from the first angle by more than 10 degrees.

14. A concrete treatment device comprising:

a frame supported on the concrete by at least one support surface;

a handle element supported by the frame and with a handle portion spaced from the frame;

a motor support movable through pivoting movement about a pivot axis relative to the frame;

a bias element extending between the handle element and the motor support configured to bias the handle element and the motor support toward each other when the motor support and the frame pivot toward each other and when the motor support and the frame pivot away from each other, and wherein a line normal to the bias element and extending from the bias element to the pivot axis is at least an inch long.

15. The device of claim 14 wherein the handle element includes a post supported by the frame and the handle portion is mounted at an end portion of the post.

16. The device of claim 15 wherein the bias element is coupled to a portion of the post.

17. The device of claim 16 wherein the bias element is coupled to a portion of the post about halfway up the post.

18. The device of claim 14 further including a height adjustment mechanism configured to move the motor support relative to the frame.

19. The device of claim 18 wherein the height adjustment mechanism extends from the handle element to the motor support.

20. The device of claim 19 wherein the height adjustment mechanism is non-parallel with the bias element.

21. The device of claim 19 wherein the bias element is coupled to the motor support at a first coupling area and the height adjustment mechanism is coupled to the motor support between the first coupling area and the pivot axis.

22. The device of claim 21 wherein the height adjustment mechanism crosses the bias element.

23. The device of claim 21 wherein the bias element is coupled to the handle element and the height adjustment mechanism is coupled to the handle element above the bias element.

24. The device of claim 19 wherein the height adjustment mechanism includes a screw element.

25. The device of claim 14 wherein the bias element is coupled to the handle element approximately halfway between the handle portion and the frame.

26. The device of claim 25 wherein the bias element includes two springs.

27. The device of claim 25 wherein the bias element extends over a given length and wherein the length is adjustable.

28. The device of claim 25 wherein the bias element is coupled to the motor support through a coupling element.

29. The device of claim 28 further including a height adjustment mechanism coupled to the motor support between the coupling element and the pivot axis.

30. A concrete treatment device comprising:

a frame supported on the concrete by at least one support surface;

a handle element supported by the frame and with a handle portion spaced from the frame;

a motor support movable through pivoting movement about a pivot axis relative to the frame;

a bias element extending between the handle element and the motor support biasing the handle element and the motor support toward each other, wherein a line normal to the bias element and extending from the bias element to the pivot axis is at least an inch long and wherein the bias element includes two springs.

* * * * *